US005908534A

United States Patent [19]

Larsson et al.

[11] Patent Number: 5,908,534

[45] Date of Patent: Jun. 1, 1999

[54] METHOD AND DEVICE FOR WEB CUTTING IN THE FORMER OF A PAPER MACHINE

[75] Inventors: L. Hans-Erik Larsson, Karlstad, Sweden; Dieter Eickeler, Marsberg-Obermarsberg; Jörg Reine, Marsberg-Leitmar, both of Germany

[73] Assignee: Valmet-Karlstad AB, Karlstad, Sweden

[21] Appl. No.: 08/099,066

[22] Filed: Jul. 27, 1993

[30] Foreign Application Priority Data

Aug. 4, 1992 [SE] Sweden ..... 9202280

[51] Int. Cl.[6] ..... D21F 1/36

[52] U.S. Cl. ..... 162/193; 162/195; 162/286; 162/301; 162/334; 162/353; 162/310

[58] Field of Search ..... 162/193, 194, 162/195, 255, 286, 300, 301, 310, 334, 353

[56] References Cited

U.S. PATENT DOCUMENTS

| | | | |
|---|---|---|---|
| 1,279,756 | 9/1918 | Pope | 162/193 |
| 1,679,523 | 8/1928 | Heisel | 162/195 |
| 2,709,398 | 5/1955 | Beachler | 162/194 |
| 2,857,822 | 10/1958 | Heys | 162/286 |
| 3,556,936 | 1/1971 | Miyamoto | 162/286 |
| 3,652,390 | 3/1972 | Peterson | 162/303 |
| 3,839,148 | 10/1974 | Beck | 162/310 |
| 4,124,441 | 11/1978 | Nykopp | 162/353 |
| 4,153,504 | 5/1979 | Justus | 162/301 |
| 4,560,438 | 12/1985 | Tell et al. | 162/194 |
| 4,576,681 | 3/1986 | Schiel | 162/353 |

*Primary Examiner*—Karen M. Hastings
*Attorney, Agent, or Firm*—Alston & Bird LLP

[57] ABSTRACT

A method and device for cutting a paper web (9) in a twin wire former (1) is described, said web being formed between two forming fabrics (4, 5) while wrapping a section of a forming roll (3), and the web cutting being carried out with the aid of jet cutters (10, 11) discharging jets of pressure medium so that a paper web of final width is obtained and, when applicable, a tail in the web. The jet cutters (10, 11) are arranged at the forming roll (3) so that the web cutting is carried out in the web at a point where the recently formed paper web (9) and the forming fabrics (4, 5) together wrap said section of the forming roll (3) in a sandwich structure.

16 Claims, 2 Drawing Sheets

METHOD AND DEVICE FOR WEB CUTTING IN THE FORMER OF A PAPER MACHINE

FIELD AND BACKGROUND OF THE INVENTION

The present invention relates to a method and device for cutting a paper web in the twin wire former of a paper machine.

Web cutting in the form of tail and/or edge cutting at the end of the forming fabric of a former is known, for instance, through U.S. Pat. Nos. 1,279,756, 2,709,398, 2,857,822 and 4,560,438.

In a twin wire former the paper web is trimmed and/or cut to a tail while being supported by one of the forming fabrics, at a point immediately before the pick-up means. A tail (also called a leader) is a strip, which is separated from the web at the wet end of a paper machine, ahead of the press section, in order to facilitate the threading of the web through the machine. For the cutting, usually water jets are used which encounter the paper web at relatively high pressure in order to form edge trimmings and a trimmed web and, when applicable, a tail, of predetermined width. One drawback is that, after slitting the paper web, the water jets spread so that water splashes all around the area. If the supporting fabric is a felt, as is the case in a crescent former, there is a considerable risk of fibers and fiber fragments being pressed into the felt and thereby giving rise to streaks in the paper web of final width when the tail cutting is complete. The pressure of the fluid jet must be limited in order to reduce the risk of the felt being damaged by the fluid jet. Repeated and extended tail cutting obviously increases said problem of fibers and fiber fragments being pressed into the felt, as well as the felt being damaged by the fluid jet even if the pressure thereof is maintained at a lower level. This in turn means that tail cutting is limited to paper webs having low basis weight such as below 30 g/m$^2$ in uncreped state and that trimming cannot be performed at all on the felt at a point immediately before the pick-up means. If the stock contains wet strengthener, the basis weight limit is reduced still further. In order to obtain a paper web with straight edges and of a predetermined width in a crescent former, therefore, the outer forming fabric may be provided with impermeable edge portions as disclosed in U.S. Pat. No. 3,652,390. The inner, parallel edges of said edge portions, facing each other, thus determine the width of the finished paper web and said width is selected depending on the grade of soft paper to be produced. When the production of soft paper is to be changed from one grade to another, e.g. from tissue to towel paper, the width of the finished paper web must be altered in order to avoid undesirable losses during conversion of the paper web to the intended final products. To enable such alteration in the production from one grade to another, the outer forming fabric of the crescent former must be dismantled and replaced with another forming fabric with a different width between the impermeable edge portions. This exchange is troublesome and time-consuming and entails an undesirable loss of production. Furthermore, increased costs are incurred for forming fabrics as well as space to store them.

SUMMARY OF THE INVENTION

The object of the present invention is to provide a method and device for web cutting in the former of a paper machine which addresses the problems mentioned above.

The present invention relates to a method of cutting a paper web in a twin wire former of a paper machine, said web being formed between two forming fabrics while wrapping a section of a forming roll, said web cutting being carried out with the aid of at least one jet of pressure medium, wherein cutting of the web is performed at a point on the forming roll where the recently formed paper web and the forming fabrics together wrap the forming roll in a sandwich structure.

The invention also relates to a device for cutting a paper web in a twin wire former of a paper machine, comprising a forming roll and two forming fabrics arranged to wrap a section of the forming roll together with a recently formed paper web enclosed therebetween, at least one jet cutter being arranged to cut the web, wherein said at least one jet cutter is arranged at a point on the forming roll where the recently formed paper web and the forming fabrics together wrap a section of the forming roll in a sandwich structure.

By performing web cutting on the actual forming roll in accordance with the invention, it has surprisingly been found that there is no risk of fibers and fiber fragments being pressed into the felt or of the felt being damaged by the jets of pressure medium. Equally surprisingly it has been found that tail cutting can also be performed on paper webs with basis weights over about 30 g/m$^2$ in uncreped state, without fibers and fiber fragments being pressed into the felt and without the jet of pressure medium damaging the felt. Trimming can also be performed at such high basis weights without problem. The space around the forming roll is closed and performing web cutting in this closed space eliminates the problem of water splashing from the jet cutter or cutters to the surroundings.

The invention will be described further in the following with reference to the accompanying drawing.

DESCRIPTION OF PREFERRED EMBODIMENTS

Figure 1:
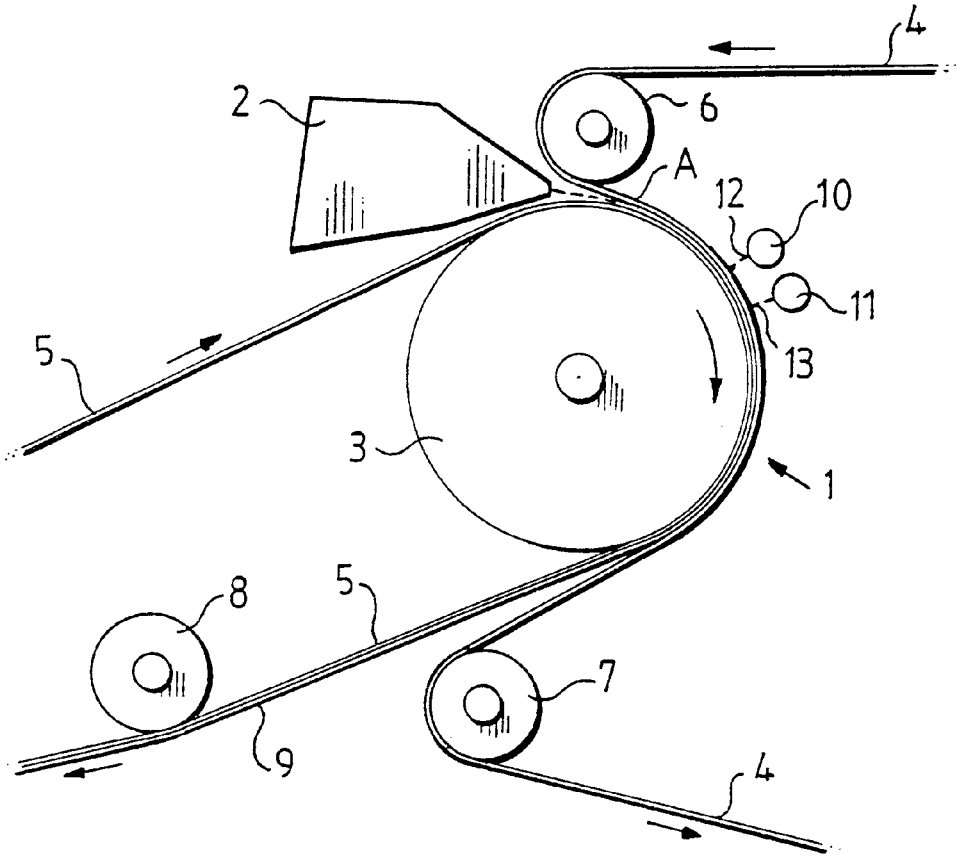
FIG. 1 is a schematic side view of a part of the wet section of a paper machine with a twin wire former of the crescent former type.
Figure 2:
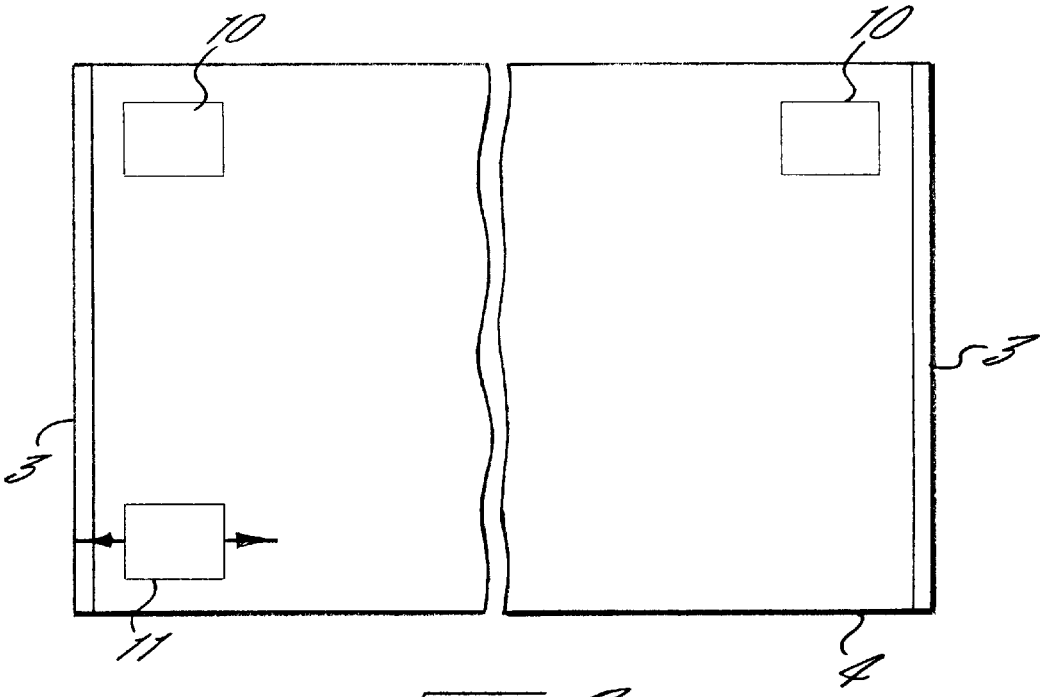
FIG. 2 is a schematic front elevational view of the part of the wet section of the paper machine shown in FIG. 1.

With reference to FIG. 1 this shows schematically parts of a wet section in a paper machine suitable for producing soft paper such as tissue and other paper hygienic products. The wet section comprises a twin wire former 1 and a headbox 2. The twin wire former shown is of the crescent former type and has a forming roll 3, an outer forming fabric 4 and an inner forming fabric 5 which thus consists of a felt. The two forming fabrics 4, 5 run together over the forming roll 3 and then in individual loops over a plurality of rolls. The rolls pertaining to the outer forming fabric 4 comprise a breast roll 6 arranged above and close to the forming roll 3, and a guide roll 7, which can be termed a wire turning roll, arranged a short distance after the forming roll 3. One of the guide rolls over which the felt 5 passes is designated 8. The headbox 2 emits a single or multiple layered jet of stock between the two movable forming fabrics 4, 5, to form a paper web 8 by dewatering the stock.

The formed paper web leaves the outer forming fabric at a point between the forming roll 3 and guide roll 7 and is supported by the felt 5 from below and conveyed to the drying section (not shown) of the paper machine.

According to the present invention, jet cutters 10 and 11 are arranged within the area of the forming roll, to direct jets of pressure medium 12, 13, preferably water jets, against the sandwich structure formed by the outer forming fabric 4, the newly formed paper web 9 and the inner forming fabric 5, and which surrounds and is in contact with a part of the forming roll 3. According to the invention, therefore, all web cutting is performed with the aid of water jets as early as when the newly formed paper web is still enclosed between the two forming fabrics, while these and the paper web, as a sandwich structure, enclose a part of the forming roll.

The first jet cutter 10 has two nozzles spaced apart from each other, each providing a water jet 12 to slit the newly formed paper web into two edge trimmings and a paper web with the desired width of the finished paper web, the width thus corresponding to the distance between the water jets from the two nozzles. The nozzles are arranged at the same distance from the vertical central plane of the forming roll and are adjustable in relation to each other in order to increase or decrease the distance between them and, thus, the width of the paper web of final width.

The second jet cutter 11 is arranged close to one end wall of the forming roll 3 and comprises a nozzle axially displaceable in relation to the forming roll between an outer resting position close to said end wall and an inner, operative position in which a water jet 13 is discharged against said sandwich structure in order to cut a tail of predetermined width, e.g. 100–200 mm, in this paper web of final width. When the tail formed has been threaded through the paper machine and starts to be wound up in a subsequent reel-up, the tail is widened to the full width of the web by the jet cutter 11 being moved transversely over the paper web while still discharging a water jet, to the other end wall of the forming roll. The water jet is then turned off and the jet cutter 11 is returned to its said outer resting position.

The reference character A denotes a point on the forming roll 3 where the outer forming fabric 4 starts to surround the forming roll 3. The jet cutters 10, 11 are preferably located at a point located about 30–120°, most preferably about 60–90°, downstream of said point A.

The design of the jet cutters is not critical and may therefore be chosen from known types of jet cutters used in practice or described in patent literature for trimming and tail cutting of a paper web while this is being supported by a fabric.

As the two edge trimmings obtained during trimming on the forming roll are hard to remove from the inner forming fabric when the inner forming fabric is a felt as is the case in a crescent former, the edge trimmings usually will accompany the trimmed paper web of final width past the yankee dryer in the following drying section (not shown) of the crescent former and not be removed from the vicinity of the trimmed web until these parts of the web have passed the yankee dryer.

That which is claimed is:

1. A method of cutting a paper web in a paper machine having a twin wire former wherein the web is formed between an inner forming fabric and an outer forming fabric while wrapping a section of a forming roll, said method comprising directing at least one jet of pressure medium onto the web at a point on the forming roll where the recently formed paper web and the forming fabrics together wrap the forming roll in a sandwich structure and cutting the web with the at least one jet of pressure medium.

2. A method as claimed in claim 1 wherein the twin wire former of the paper machine is a crescent former in which the inner forming fabric is a felt, and the at least one jet of pressure medium is directed at the forming roll of the crescent former.

3. A method as claimed in claim 1 wherein the web is cut at a point on the forming roll located about 30–120° downstream of a point where the outer of the two forming fabrics starts wrapping the forming roll.

4. A method as claimed in claim 3 wherein the web is cut at a point on the forming roll located about 60–90° downstream of a point where the outer of the two forming fabrics starts wrapping the forming roll.

5. A method as claimed in claim 3 wherein the twin wire former of the paper machine is a crescent former in which the inner forming fabric is a felt, and wherein the web is cut on the forming roll of the crescent former.

6. A method as claimed in claim 1 including the step of directing at least one additional jet of pressure medium onto the web at a point on the forming roll where the recently formed paper web and the forming fabrics together wrap the forming roll in a sandwich structure to thereby cut a tail of predetermined width in the web.

7. A method as claimed in claim 6 including the step of moving said at least one additional jet of pressure medium transversely over the paper web to thereby widen the tail to the full width of the web.

8. A paper machine comprising a twin wire former including a forming roll and inner and outer forming fabrics arranged to wrap a section of the forming roll together with a recently formed paper web enclosed therebetween, at least one jet cutter arranged to cut the web, said at least one jet cutter being positioned at a point on the forming roll where the recently formed paper web and the forming fabrics together wrap said section of the forming roll in a sandwich structure, and said at least one jet cutter comprising a nozzle arranged to provide a jet of pressure medium against the sandwich structure to cut the web.

9. A device as claimed in claim 8 wherein said twin wire former is a crescent former in which said inner forming fabric is a felt, and said at least one jet cutter is arranged on the forming roll of said crescent former.

10. A device as claimed in claim 8 wherein said at least one jet cutter is arranged at a point on the forming roll located about 30–120° downstream of a point where the outer of the two forming fabrics starts wrapping said section of the forming roll.

11. A device as claimed in claim 10 wherein said at least one jet cutter is arranged at a point on the forming roll located about 60–90° downstream of a point where the outer of the two forming fabrics starts wrapping said section of the forming roll.

12. A device as claimed in claim 10 wherein said twin wire former is a crescent former in which said inner forming fabric is a felt, and said at least one jet cutter is arranged on the forming roll of said crescent former.

13. A device as claimed in claim 12 wherein said at least one jet cutter includes an additional nozzle mounted for adjustable movement in relation to said first mentioned nozzle to allow adjustment of the width of the paper web to any required width of a desired grade of paper.

14. A device as claimed in claim 9 wherein said at least one jet cutter includes an additional nozzle mounted for adjustable movement in relation to said first mentioned nozzle to allow adjustment of the width of the paper web to any required width of a desired grade of paper.

15. A device as claimed in claim 12 further comprising a second jet cutter located downstream from at least one jet cutter, said second jet cutter directing a jet of pressure medium against said sandwich structure so as to cut a tail of predetermined width in said paper web.

16. A device as claimed in claim 9 further comprising a second jet cutter located downstream from at least one jet cutter, said second jet cutter directing a jet of pressure medium against said sandwich structure so as to cut a tail of predetermined width in said paper web.

* * * * *